US006070770A

United States Patent [19]

Tada et al.

[11] Patent Number: 6,070,770

[45] Date of Patent: Jun. 6, 2000

[54] AEROSOL FLOW REGULATOR

[75] Inventors: Yukitoshi Tada; Naomi Iizuka, both of Yokohama; Yutaka Takeguchi, Tokyo, all of Japan

[73] Assignee: Precision Valve Japan, Limited, Japan

[21] Appl. No.: 09/222,128

[22] Filed: Dec. 29, 1998

[51] Int. Cl.[7] ..... B65D 83/14

[52] U.S. Cl. ..... 222/635; 222/402.1; 222/402.16; 222/402.25

[58] Field of Search ..... 222/635, 402.1, 222/402.14, 402.16, 402.24, 402.25

[56] References Cited

U.S. PATENT DOCUMENTS

| | | | |
|---|---|---|---|
| 3,060,965 | 10/1962 | Taggart | 222/402.16 |
| 3,348,742 | 10/1967 | Assalit | 222/402.25 |
| 3,598,292 | 8/1971 | Kiliany | 222/635 |
| 3,669,316 | 6/1972 | Corsette | 222/635 |
| 5,697,532 | 12/1997 | Wilde et al. | 222/402.25 |

FOREIGN PATENT DOCUMENTS

| | | | |
|---|---|---|---|
| 0531606 | 11/1992 | European Pat. Off. | 222/402.1 |
| 2018908 | 10/1979 | United Kingdom | 222/402.24 |

*Primary Examiner*—Joseph A. Kaufman
*Attorney, Agent, or Firm*—Kilgannon & Steidl

[57] ABSTRACT

An aerosol valve and flow regulator in a valve housing for use with a can holding flowable product and compressed gas propellant. The flow regulator is positioned upstream of the aerosol valve, and includes (a) a conical valve seat of hard material extending inwardly of the valve housing and having two diametrically opposed triangular grooves extending in the flow direction, and (b) a relatively soft elastic regulating member with a spherical surface to contact and seal the conical valve seat under gas pressure from the can and to press into the two triangular grooves under higher gas pressures to regulate the flow area of the two triangular grooves over a substantial range of gas pressures to provide a substantially constant product flow rate. The one-piece valve housing has a non-obstructing interior bore upstream of the flow regulator to facilitate insertion of the regulating member. A plug member with an internal bore is inserted into the base of the valve housing to secure the regulating member, and a dip tube may be inserted into the plug member bore. The triangular grooves have width and depth dimensions preferable of 0.2 mm. The regulating member is relatively soft Santoprene® thermoplastic elastomer two-phase elastomeric alloy material with a Shore scale hardness of 55°–64° A.

10 Claims, 4 Drawing Sheets

AEROSOL FLOW REGULATOR

FIELD OF THE INVENTION

The present invention relates to aerosol valves to dispense products from pressurized containers, and more particularly to an aerosol valve in combination with a flow regulator to dispense product from a container under the influence of compressed gas.

BACKGROUND OF THE INVENTION

In known forms of aerosol valves and associated product containers, liquified propellants are filled into the can with the product to be dispensed. Such propellants provide relatively constant pressure and product flow rates as the product is dispensed through the aerosol valve. Liquified propellants have certain disadvantages, however, relating to cost, volatility, etc. It has long been proposed to use non-liquified, compressed gases such as nitrogen, carbon dioxide, etc. for the propellant in the aerosol container. Compressed gases of course are relatively inexpensive, but suffer from the disadvantage that as the product is dispensed from the can, the pressure within the can decreases substantially with the result that there is a substantially decreasing discharge rate for the product.

Numerous attempts have been made to overcome the above-noted disadvantage of using compressed gases, including providing flow regulators of one design or another in the flow path of the product and compressed gas as they are dispensed. In one known construction, the subject of Japanese Patent No. 2,512,368 for "Flow Regulating Valve" granted Apr. 16, 1996, a flow regulator is placed upstream of an aerosol valve within the valve housing. A conical valve seat is disclosed which has a single groove therein which interacts with an elastic regulating member having a portion of a spherical surface, the regulating member pressing against the conical valve seat and into the single groove under the influence of higher pressures of compressed gas used as a propellant. A further version is also disclosed wherein a conical valve seat with a large number of grooves is placed within an actuator downstream of the aerosol valve, and likewise interacts with the regulating member pressing into the grooves under the influence of the higher pressures of compressed gas. In each instance, the regulator throttles the flow discharge according to the changes in pressure as the compressed gas and product are discharged, in an attempt to obtain a relatively uniform product discharge rate. Higher gas pressures cause the regulating member to extend further into the grooves than is the case with lower gas pressures, thus varying the cross-sectional flow areas of the grooves. The grooves of the system according to the above patent are rectangular, the above-noted patent does not disclose the material of the regulating material and its relative hardness or softness, and no dimensions of the grooves are disclosed. A system according to the above-noted patent does not obtain highly uniform product discharge rates. Further, the system according to the above noted patent is more complicated in its molding and assembly due to a plurality of inwardly extending bevelled projections to secure the regulating member and which the regulating member must be pressed beyond, during assembly.

SUMMARY OF THE INVENTION

The present invention overcomes certain disadvantages of the above-noted prior art and obtains a highly uniform product discharge rate. A flow regulator is placed upstream of an aerosol valve within a one-piece valve housing. A hard conical valve seat within the housing contains two diametrically opposed triangular grooves extending along the length of the conical valve seat in the flow direction. A relatively soft elastic regulating member with a partial spherical surface is comprised of a thermoplastic elastomer marketed under the brand name Santoprene® and having a hardness preferably of 55° on the Shore A scale. For product formulations with water and alcohol, the width and depth of the two triangular grooves are preferably 0.2 mm. The above combination of design parameters provide for the regulating member to press against and seal the conical valve seat, and throttle the triangular grooves to obtain a highly uniform product discharge rate under varying pressures of compressed gas propellant in the aerosol can. The regulating member does not extend to the bottom apexes of the triangular grooves to shut off product flow under the pressures normally provided by a compressed gas propellant. Further, the design of the present invention is easily molded and assembled, the valve housing provided a free pathway for insertion of the regulating member into the housing, and a hollow plug member thereafter being inserted into the housing for securing the regulating member at the upper end of the plug and holding the aerosol dip tube internal to and at the lower end of the plug member.

Other features and advantages of the present invention will be apparent from the following description, drawings and claims.

DETAILED DESCRIPTION OF EMBODIMENTS

Figure 1:
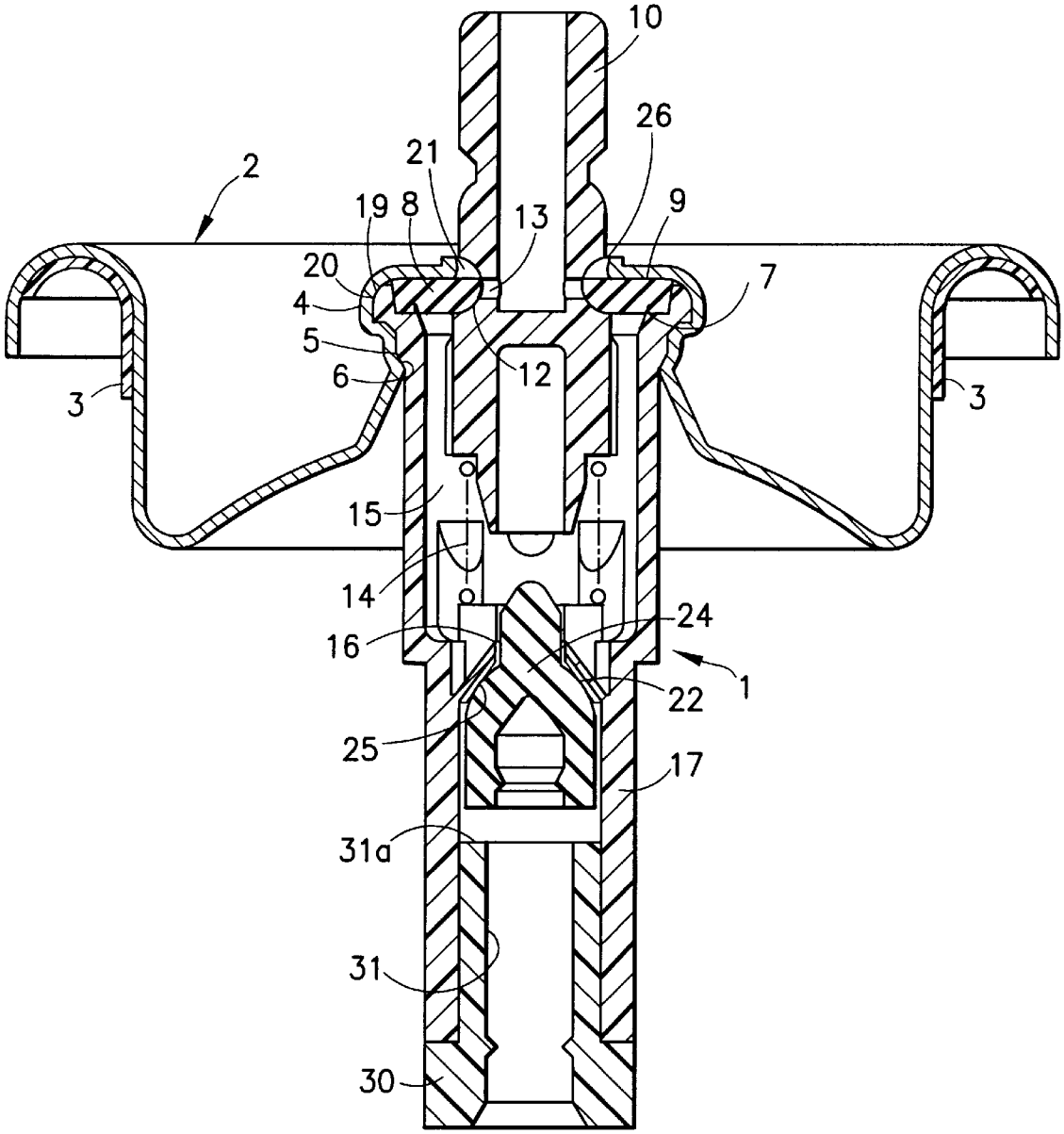
FIG. 1 is an axial cross-sectional view through an aerosol valve and mounting cup assembly, with the flow regulator of the present invention contained within the valve housing below the aerosol valve.

FIG. 1 illustrates plastic valve housing 1 of an aerosol valve fixedly inserted within metal mounting cup 2. The mounting cup 2 forms the upper part of a top of a can containing a product capable of flow and which is exposed to a gas pressure. The seal between the top of the can and the mounting cup 2 is made by means of sealant 3 of various forms as is well known in the aerosol art. The valve housing 1 is fixed to the mounting cup 2 by a pedestal wall 4 of the mounting cup being provided at a plurality of peripheral locations with inwardly impressed bulge portions 5 which engage under a flange 6 of the valve housing 1. By virtue of this arrangement, a clamping edge 7 which is provided at the top side of the valve housing 1 presses an elastic sealing gasket disc 8 against an end wall 9 of the mounting cup 2. A hollow valve stem 10 passes through a central hole in the gasket 8, and the edge of the hole bears against a constriction 12 in the valve stem 10 in which there are transverse holes 13 which communicate with the internal bore in the valve stem 10. A valve actuator (not shown) with spray nozzle or the like can be fitted onto the top of valve stem 10 in the usual manner.

Valve stem 10 is urged upwardly by a spring 14. The cavity 15 which accommodates the spring 14 communicates with the interior of the can (not shown) by way of a duct 16 which extends through a lower portion 17 of valve housing 1 and communicates with a conventional dip tube (not shown) fitted to a plug in the base of the valve housing as hereinafter described. When the valve stem 10 is depressed by an actuator attached thereto, the edge of the hole in the sealing gasket 8 is bent downward by the constriction 12. As a result the transverse holes 13 are exposed and a delivery path is opened which leads from the interior of the can outwardly through the lower housing portion 17, the cavity 15, the transverse holes 13, and the bore in the valve stem 10.

Between the pedestal wall 4 of the mounting cup 2 and the peripheral wall of the valve housing, there exists an annular deflection space 19 for the material of the sealing gasket 8 and for product filling ducts 20 which extend between the deflection space 19 and the interior of the can outside the housing 1. A central hole is provided in the end wall 9 so that there is an annual filling opening 21 around the valve stem 10. Filling of the interior of the can with product can be carried out in a conventional manner as disclosed in U.S. Pat. Nos. 4,015,752 and 4,015,757 (Meuresch et al., Apr. 5, 1997), incorporated herein by reference, by passing the product through both the bore of the valve stem 10 and the filling opening 21 surrounding the valve stem 10 into the interior of the can.

Figure 2:
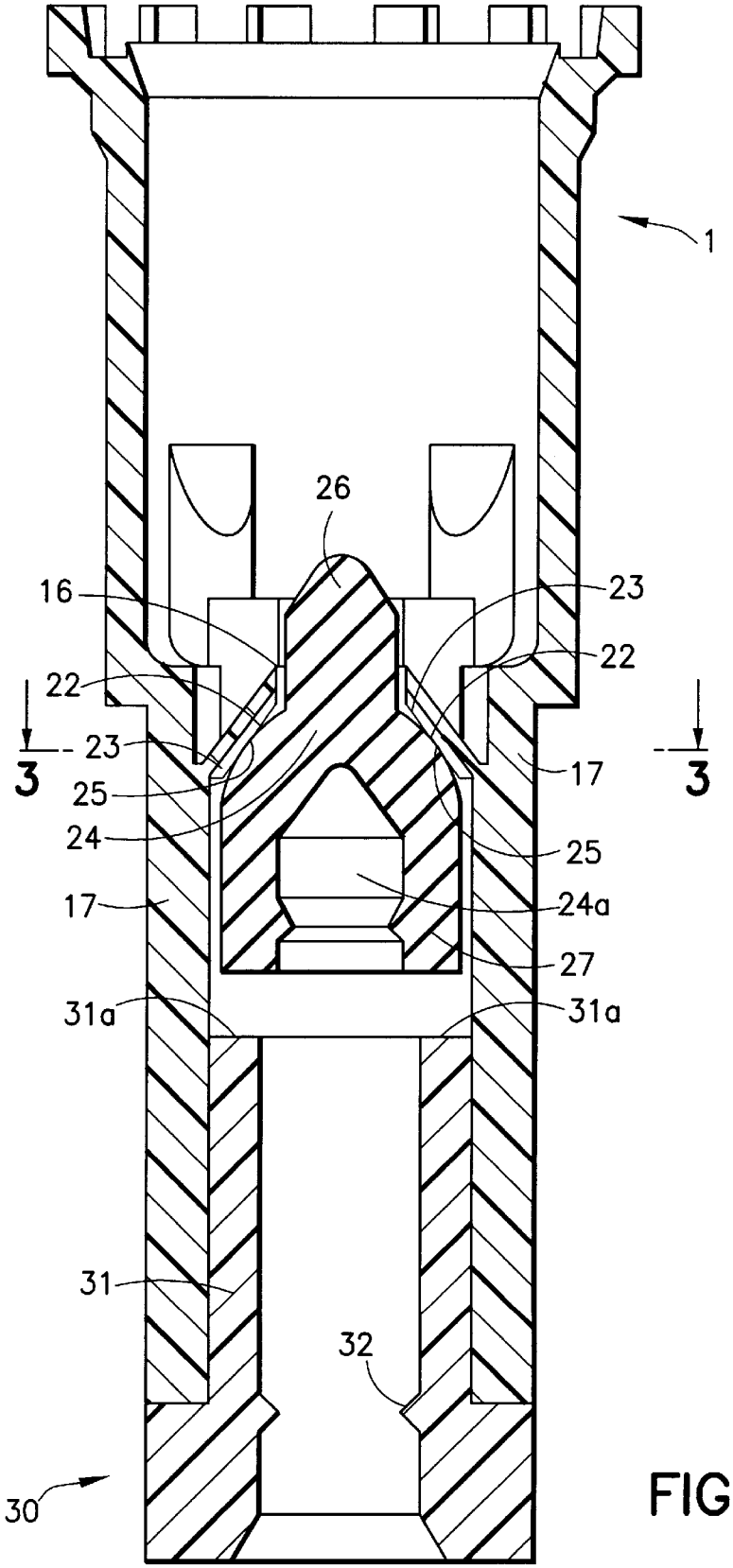
FIG. 2 is an enlarged view of the valve housing and flow regulator components of FIG. 1.
Figure 3:
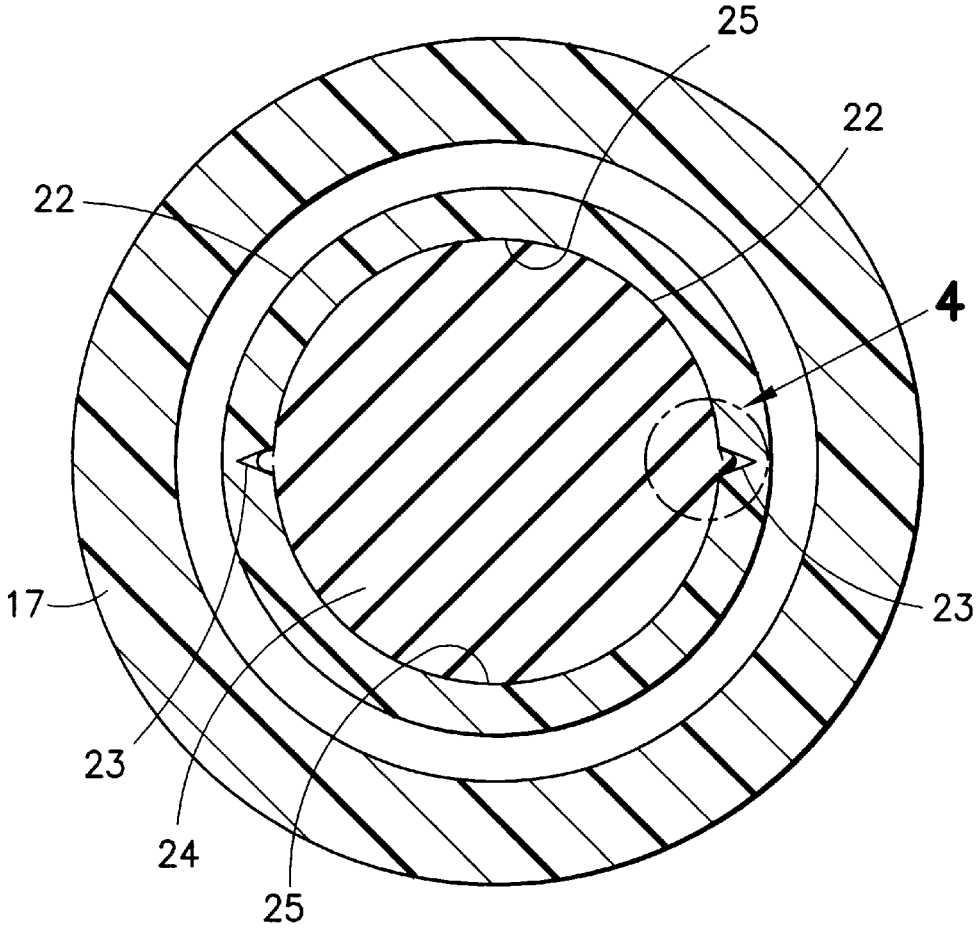
FIG. 3 is a cross-sectional view of the flow regulator taken at the level of lines 3—3 of FIG. 2, illustrating the two triangular regulating grooves of the present invention and with the flow regulator operating under different pressures in the aerosol container.

Referring to FIGS. 2 and 3, the flow regulator of the present invention is provided in the duct 16 in the lower portion 17 of valve housing 1. The flow regulator has a hard valve seat 22 in the form of a conical shoulder surface in the lower portion 17 of the valve housing 1. Provided in the valve seat 22 are two diametrically opposed, triangular, grooves 23 of constant cross-sectional area which extend along the length of conical valve seat 22 in the flow direction, and which together with regulating member 24 delimit a throttle duct. Conical valve seat 22 serves to center the regulating member 24. Member 24 is formed of a relatively soft thermoplastic elastomer material, in particular a two-phase elastomeric alloy marketed under the brand name Santoprene® available from Advanced Elastomer Systems and having a hardness preferably of 55° on the Shore A scale. A hardness of 64° on the Shore A scale also is acceptable. These two Santoprene® materials are respectively specified as thermoplastic rubber grade 201-55 and 201-64 in accordance with the Standard ASTM D 2240. The surface 25 of the regulating member 24 which cooperates with valve seat 22 is formed by a part of the surface of a spherical zone, from the top and bottom of which extend cylinders 26 and 27 respectively. It is also possible that a conical surface 25 would function adequately in the present invention. The outside diameter of cylinders 26 and 27 are somewhat smaller than the inside diameters of the adjacent portions of the delivery duct 16 and lower housing portion 17 disposed around the cylinders 26 and 27 at the top and bottom of the valve seat, respectively. Regulating member 24 has internal pressure-receiving cavity 24*a*.

Extending into the bottom of lower housing portion 17 is plug member 30. Housing 1 and plug member 30 may be formed of acetal, for example, for its advantage over nylon in terms of not swelling and better retention between the valve housing and plug, and plug and dip tube. Plug member 30 has upwardly extending hollow cylinder 31 terminating in top surface 31*a* thereof. In assembling the flow regulator, regulating member 24 is first inserted upwardly through the bottom of lower housing portion 17 to the position of FIG. 2, lower housing portion 17 having no internal securing projections to interfere with the easy insertion by automatic machinery of elastic regulating member 24. Thereafter occurs the insertion of plug member 30 into the bottom of lower housing portion 17. The conventional dip tube (not shown) is then inserted upwardly into the hollow opening of plug 30, the dip tube having a spring weight at its bottom to properly position the tube in the can. Circumferential flange 32 extending inwardly about the hollow bore of plug 30 serves to firmly grasp the dip tube. Top surface 31a of plug 30 serves to retain regulating member 24 within lower housing portion 17, and to provide a surface against which regulating member 24 can fall downwardly when the aerosol valve is not activated.

Figure 5:
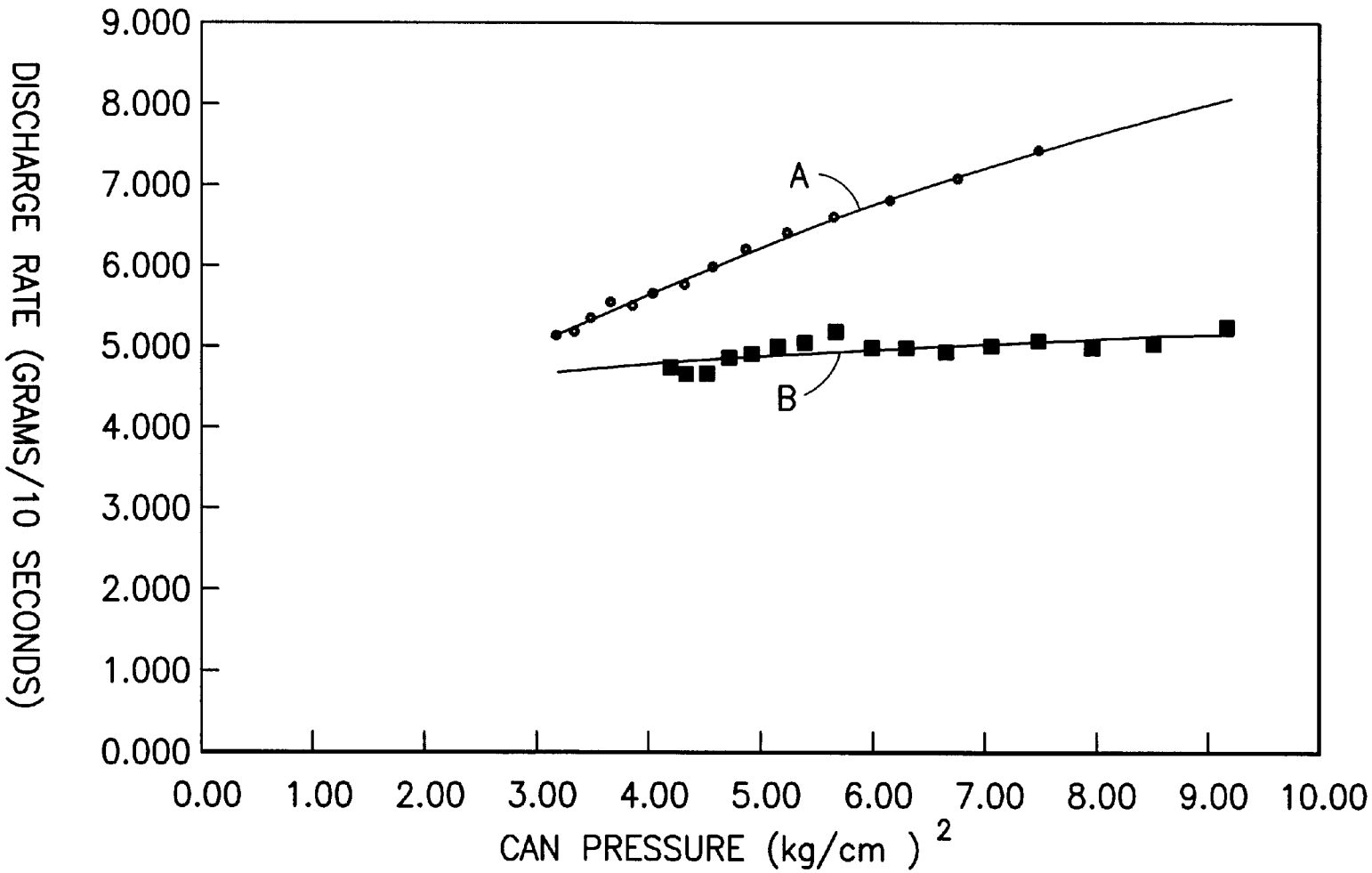

The present invention has particular applicability when a compressed gas (such as nitrogen, for example) is used as the propellant to deliver the product from the aerosol can. It of course is desirable that the discharge rate of product from the can remain essentially constant over a wide range of can pressures as product continues to be dispensed, and the flow regulator of the present invention is successful in obtaining this desirable result with compressed gas propellants. FIG. 5 illustrates this result, with plot B showing the essentially constant discharge rate over a wide range of pressure in the can. Plot A, on the other hand, shows the varying discharge rate over a wide range of can pressure for an aerosol valve operating under compressed gas but without the flow regulator of the present invention. The test conditions of FIG. 5 were a temperature of 25° C., nitrogen propellant, and ten second sprays at ten second intervals. Plot B of FIG. 5 has the equation $Y=4.2063\ X^{0.0884}$, Y being the discharge rate and X being the can pressure.

Figure 4:
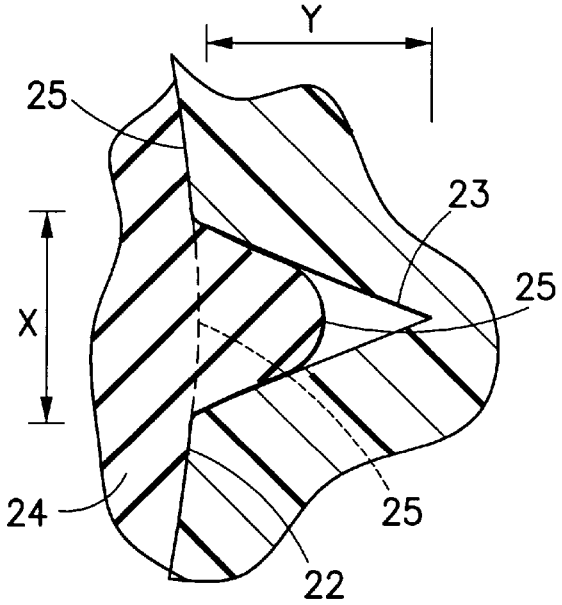
FIG. 4 is an exploded partial view taken from FIG. 3 and illustrating the flow regulator operating under different pressures in the aerosol can; and, FIG. 5 is a graph illustrating the flow regulating characteristics of the present invention in comparison with the discharge rate versus can pressure characteristics of a conventional aerosol valve lacking the present invention.

Now turning to the operation of the flow regulator structure of the present invention as described above, FIG. 2 and FIGS. 3 and 4 (dotted line versions at triangular grooves 23) illustrate regulator member 24 in a position of relatively low can pressure when a considerable volume of the compressed gas in the can has already been expelled with product. In this circumstance, the curved spherical zone surface 25 is pressed against the conical valve seat 22 without substantially extending into the two triangular grooves 23. As will be noted, product flow up hollow bore of plug 30 enters into central cavity 24*a* of regulating member 24 to create this pressing action. FIGS. 3 and 4 in their solid line versions at the triangular grooves 23 illustrate what happens when regulator member 24 is under relatively high pressure, that is when little of the compressed gas or product has been expelled from the can. Curved spherical zone surface 25 is now pressed to a greater extent against conical valve seat 22, and is shown extending substantially into the two triangular grooves 23. It accordingly can be seen that the flow regulator provides for the whole area of the two triangular grooves 23 to pass product under the lower pressure circumstance, but for only a small portion of the area of the two triangular grooves 23 to pass product under the higher pressure circumstance. Surface 25 is pressed into the grooves 23 to a greater or lesser extent depending on the internal can pressure, and the consequently varying cross-sectional area of the flow portion of the grooves acts to maintain the product discharge rate constant under the varying pressures. Accordingly, the substantially constant product discharge rate of FIG. 5 is obtained.

Several aspects of the design of the present invention are believed in combination to be significant to the successful results obtained. In particular, the triangular shape of the grooves 23 has been found to provide a better regulation of the product discharge than obtained by other shapes of grooves 23, in particular rectangles in cross section. It is also important that there be two triangular grooves, rather than one or more than two, to obtain the results of the present invention. Also, the dimensions of grooves 23 are significant. For product formulations with water and alcohol, the x and y preferred dimensions of each groove in cross section, and the depth of each groove, were determined to be 0.2 mm and at least within the range of 0.15–0.30 mm. Further, the relative softness of regulating member 24, preferably 55°–64° Shore A for product formulations with water and alcohol, in combination with the triangular grooves 23 of the preferred dimensions, allows the regulating member 24 to extend into the grooves 23 as shown in FIG. 4 under higher pressure circumstances, while not extending to the bottom apex of the triangular grooves to shut off all flow under the pressures provided by a compressed gas propellant in an aerosol can.

In the sample embodiment, cylinder 27 of regulating member 24 has an outer diameter of 3.38 mm; regulating member 24 has a total height of 6.45 mm; and surface 25 of regulating member 24 has a radius of 1.75 mm. Cylinder 27 of regulating member 24 also may have four equally spaced small grooves about its surface extending from top to bottom in an axial direction to smoothly flow product from the can along the sides of cylinder 27 to the aforedescribed throttle duct.

It will be appreciated by persons skilled in the art that variations and/or modifications may be made to the present invention without departing from the spirit and scope of the invention.

What is claimed is:

1. An aerosol valve and flow regulator assembly for use with a can containing product to be dispensed and compressed gas propellant, comprising in combination an aerosol valve and a valve housing containing the aerosol valve and flow regulator; said flow regulator being positioned upstream of the aerosol valve and including a conical valve seat of hard material extending inwardly of the valve housing and having two diametrically opposed triangular grooves extending along the length of the conical valve seat in the flow direction; said flow regulator further including a relatively soft elastic regulating member having a surface for contacting and sealing the conical valve seat under gas pressure from the can and for pressing into said two triangular grooves under higher gas pressures to regulate the product flow area of the two triangular grooves over a substantial range of gas pressures, to provide a substantially constant product flow rate over the substantial range of gas pressures.

2. The invention of claim (1), wherein the regulating member surface for contacting and sealing the conical valve seat is a spherical surface.

3. The invention of claim (1), wherein the valve housing is a one-piece member having a non-obstructing interior bore upstream of the flow regulator.

4. The invention of claim (1), further including a plug member inserted into the base of the valve housing, said plug member having an internal bore for retaining a dip tube and said plug member having an upper end for securing the regulating member within the valve housing.

5. The invention of claim (1), wherein the two triangular grooves each have a width and depth dimension within the range of 0.15 to 0.30 mm.

6. The invention of claim (5), wherein the width and depth dimension is 0.2 mm.

7. The invention of claim (1), wherein the regulating member is a relatively soft elastic member formed of a thermoplastic elastomer two-phase elastomeric alloy material having a hardness of 55°–64° on the Shore A scale.

8. The invention of claim (1), wherein each triangular groove has a constant cross-sectional area along the length of the conical valve seat.

9. The invention of claim (4), wherein the valve housing and the plug are formed of acetal.

10. The invention of claim (7), wherein the hardness is 55° Shore A.

* * * * *